US005964048A

United States Patent [19]

Shieh

[11] Patent Number: 5,964,048

[45] Date of Patent: Oct. 12, 1999

[54] SPIKE CONSTRUCTION OF GOLF SHOES

[76] Inventor: Shanq-Ching Shieh, 6Fl., No. 105, Yung-An St., Yuanlin Chen, Changhua Hsien, Taiwan

[21] Appl. No.: 09/162,179

[22] Filed: Sep. 28, 1998

[51] Int. Cl.[6] ..... A43C 15/02; A43C 15/16; A43C 13/04

[52] U.S. Cl. ..... 36/134; 36/127; 36/67 A; 36/67 D; 36/65

[58] Field of Search ..... 36/134, 67 R, 36/67 A, 67 D, 59 R, 62, 65, 126, 127, 34 A; D2/947

[56] References Cited

U.S. PATENT DOCUMENTS

| | | | |
|---|---|---|---|
| 2,276,887 | 3/1942 | Smith | 36/59 R |
| 2,412,788 | 12/1946 | Vietas et al. | 36/134 |
| 2,689,417 | 9/1954 | Bernstein | 36/59 R |
| 3,055,125 | 9/1962 | Ronci | 36/34 A |
| 3,119,192 | 1/1964 | Ronci | 36/34 A |
| 3,178,835 | 4/1965 | Burke et al. | 36/34 A |
| 3,186,112 | 6/1965 | Ball | 36/34 A |
| 3,225,465 | 12/1965 | Ball | 36/34 A |
| 5,655,317 | 8/1997 | Grant | 36/134 |
| 5,791,071 | 8/1998 | Rosdail | 36/134 |

*Primary Examiner*—Paul T. Sewell
*Assistant Examiner*—Anthony Stashick
*Attorney, Agent, or Firm*—Holland & Hart LLP

[57] ABSTRACT

A golf shoe spike includes a disk having a plurality of stubs extending from the underside thereof and a hole defined centrally therethrough. The disk has a recess defined in the underside and a plurality of protrusions extend radially inward from the periphery defining the recess. A bolt has a head and a threaded shank which extends through the hole of the disk and the head has a plurality of notches defined in the periphery thereof so as to receive the protrusions therein.

2 Claims, 3 Drawing Sheets

SPIKE CONSTRUCTION OF GOLF SHOES

FIELD OF THE INVENTION

The present invention relates to the construction of golf shoe spikes comprising a studded disk with a recess defined in the underside thereof, and a bolt received in the recess with the shank of the bolt extending through the disk to be attached to the golf shoe.

BACKGROUND OF THE INVENTION

A construction of a golf shoe spike includes a disk (50) having a plurality of stubs (51) extending from the underside thereof and a threaded shank (52) extending from the upper side thereof, two apertures (53) respectively defined in the underside of the disk (50) so that the tool (54) engages the disk (50) by inserting two engaging protrusions (55) into the two apertures (53) and the threaded shank (52) is engaged with the threaded hole (56) in the sole of the golf shoe by rotating the tool (54) together with the disk (50). The disk (50) and the stubs (51) are made of a plastic material so that the stubs (51) are slightly flexible and more comfortable to the wearer. The threaded shank (52) is required to be made of metal so as to securely engaged with the threaded hole (56). The threaded shank (52) is joined to the disk (50) during the plastic injection molding of the disk (50). It is difficult to ensure the correct positional alignment of the threaded shank (52) in the disk (50) when using this method. That is to say, the threaded shank (52) is apt to tilt relative to the disk (50) so that the quality control rejection rate of the products is high.

The present invention intends to provide a golf shoe spike construction wherein the bolt is engaged with the disk by receiving the head of the bolt into the recess in the underside of the disk. The spike construction of the present invention is easily manufactured and assembled so as to mitigate the shortcomings of the conventional spike construction.

SUMMARY OF THE INVENTION

In accordance with one aspect of the present invention, there is provided a golf shoe spike, comprising a disk having a plurality of stubs extending from the underside thereof and a hole defined centrally therethrough. A recess is defined in the underside of the disk and a plurality of protrusions extend radially inward from the periphery defining the recess. A bolt with a head and a threaded shank extends through the hole of the disk. The head has a plurality of notches defined in the periphery thereof so as to receive the tool and disk protrusions therein.

An object of the present invention is to provide a golf shoe spike which is easily manufactured and assembled.

Further objects, advantages, and features of the present invention will become apparent from the following detailed description with appropriate reference to the accompanying drawings.

DETAILED DESCRIPTION OF THE PREFERRED EMBODIMENT

Figure 2:
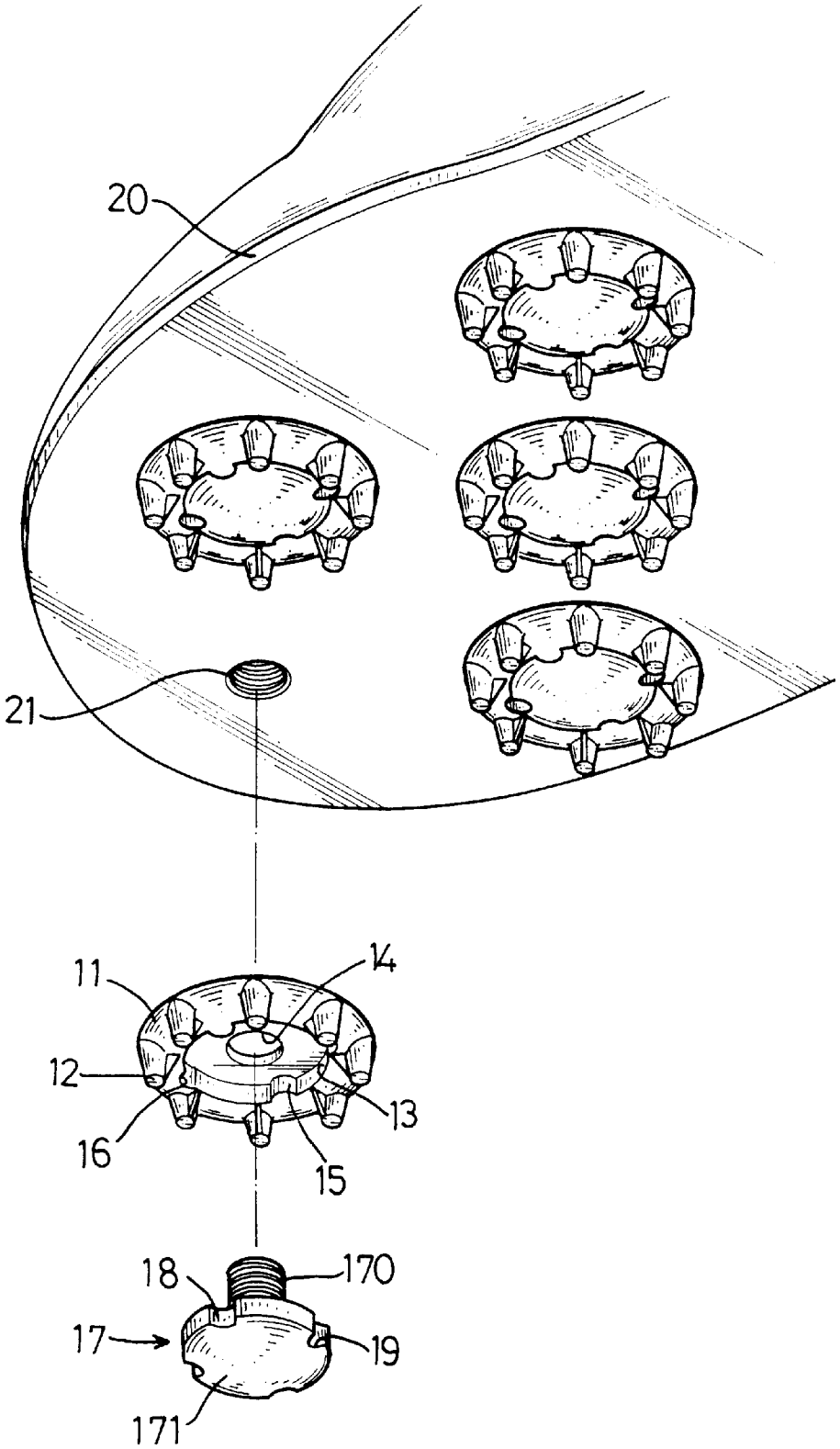
FIG. 2 is an exploded view of the spike construction in accordance with the present invention.
Figure 3:
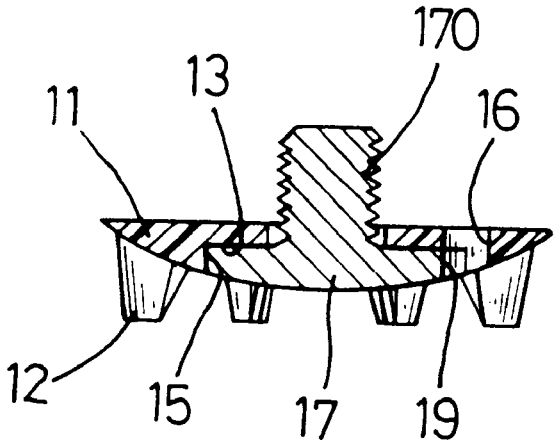
FIG. 3 is a side elevational view, partly in section, of the spike construction in accordance with the present invention.
Figure 4:
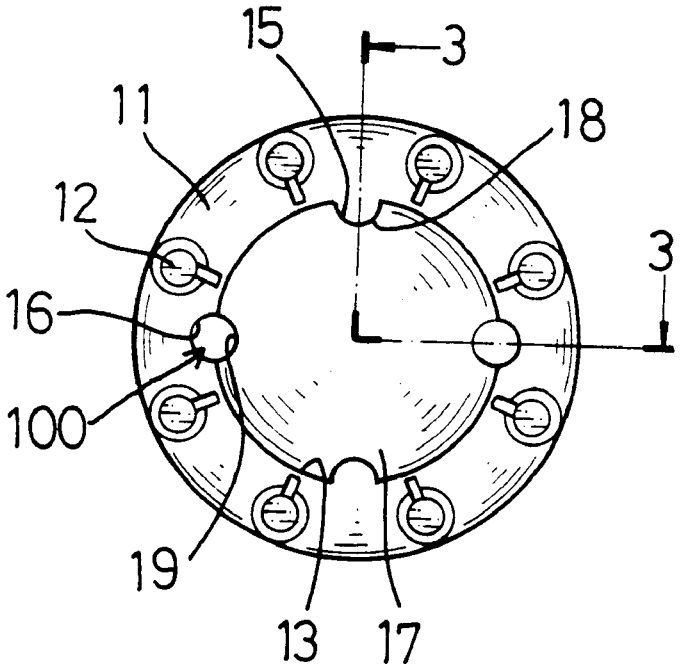
FIG. 4 is a bottom plan view of the spike in accordance with the present invention.

Referring to FIGS. 2 to 4, the golf shoe spike comprises a disk (11) having a plurality of stubs (12) extending from the underside thereof and a hole (14) defined centrally therethrough. A recess (13) is defined in the underside of the disk (11) and a plurality of protrusions (15) extend radially inward from the periphery defining the recess (13) with which the hole (14) communicates. A bolt (17) has a head (171) and a threaded shank (170) extending from the head (171) and through the hole (14) of the disk (11) with the head (171) received in the recess (13). The head (171) has a plurality of a notches (18) defined in the periphery thereof so as to receive the disk protrusions (15) therein. The periphery defining the recess (13) has two first semi-circular notches (16) and the head (171) has two second semi-circular notches (19) defined in the periphery thereof and so that the two first semi-circular notches (16) and the two semi-circular notches (19) respectively define two apertures (100) when the head (171) is received in the recess (13) with the protrusions (15) received in the notches (18).

Figure 1:
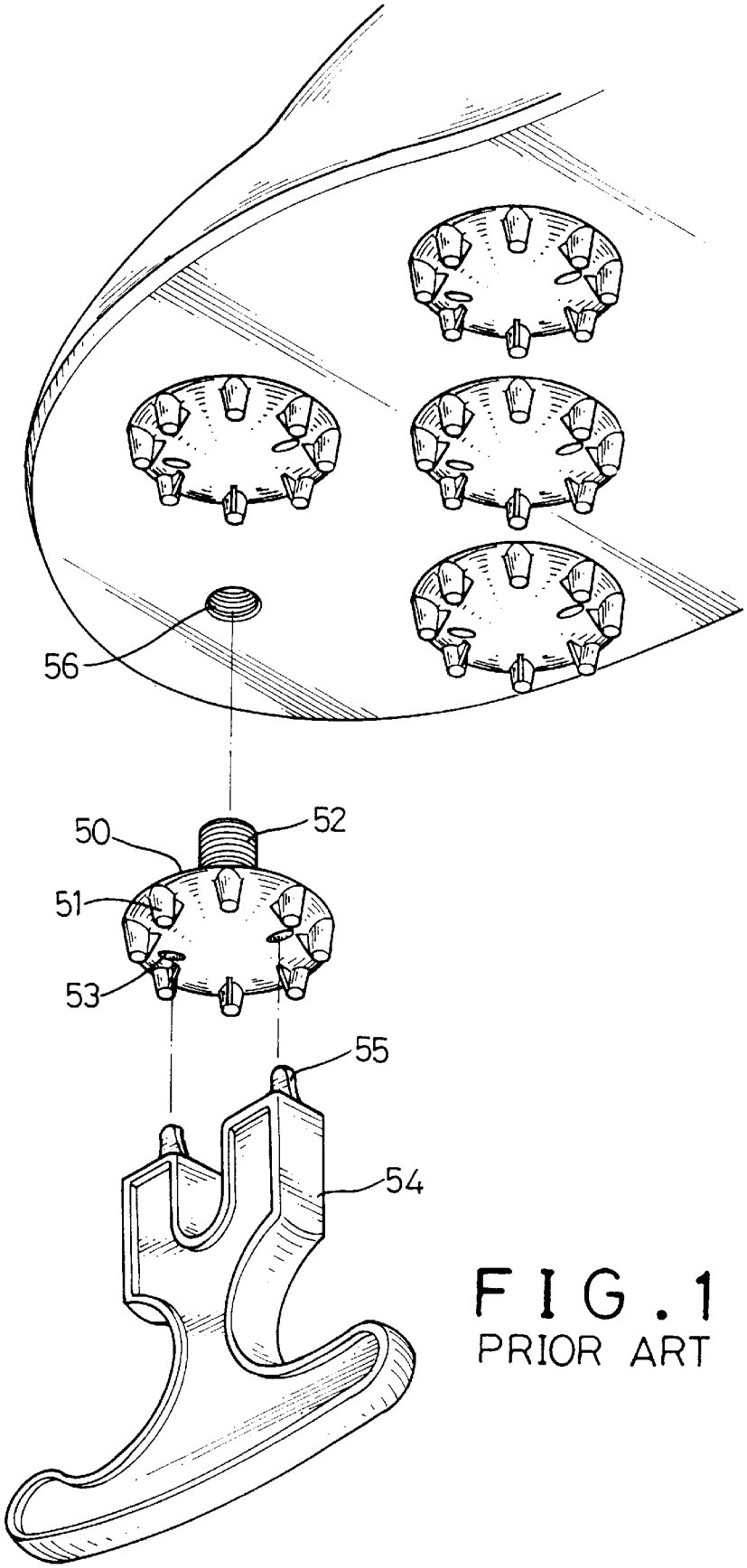
FIG. 1 PRIOR ART
FIG. 1 is an exploded view of the conventional spike construction, the golf shoe and a tool.

When installing the spike in the sole (20) of the golf shoe, the two protrusions (55) of the tool (54) as shown in FIG. 1 are inserted into the two apertures (100) of the spike to screw the threaded shank (170) into the threaded holes (21). Because the disk protrusions (15) mesh with the notches (18) in the head (171) of the bolt (17), the disk (11) and the bolt (17) rotate in unison and ensure their alignment with the sole (20) of the shoe.

The disk (11) is easily replaced in case of damaged or wear such that the replacement can be done within a very short period of time by the wearers. Because the disk (11) and the bolt (17) are manufactured separately. The proper material can be selected according to practical needs.

Although the invention has been explained in relation to its preferred embodiment, it is to be understood that many other possible modifications and variations can be made without departing from the spirit and scope of the invention as hereinafter claimed.

What is claimed is:

1. A golf shoe spike, comprising:

a disk (11) having a plurality of stubs (12) extending from the underside thereof and a hole (14) defined centrally therethrough, a recess (13) defined in the underside of said disk (11) and a plurality of protrusions (15) extending radially inward from the periphery defining said recess (13), and a bolt (17) having a head (171) and a threaded shank (170) extending from said head (171) and through said hole (14) of said disk (11), said head (171) having a plurality of notches (18) defined in the periphery thereof so as to receive said protrusions (15) therein.

2. The spike construction as claimed in claim 1, wherein the periphery defining said recess (13) has two first semi-circular notches (16) and said head (171) has two second semi-circular notches (19) defined in the periphery thereof and so that said two first semi-circular notches (16) and said two semi-circular notches (19) respectively define two apertures (100) when said head (171) is received in said recess (13).

* * * * *